US006003345A

United States Patent [19]

Jordan

[11] Patent Number: 6,003,345

[45] Date of Patent: Dec. 21, 1999

[54] KNIT GARMENT AND ORIENTATION METHOD

[75] Inventor: Bobby Ray Jordan, Burlington, N.C.

[73] Assignee: B.B. & T. Knitting Limited, Bahamas

[21] Appl. No.: 08/797,797

[22] Filed: Feb. 7, 1997

Related U.S. Application Data

[60] Provisional application No. 60/034,705, Jan. 3, 1997.

[51] Int. Cl.[6] ..... D04B 9/56

[52] U.S. Cl. ..... 66/215; 66/187

[58] Field of Search ..... 66/8, 9 R, 13, 66/17, 20, 25, 215, 171, 178 R, 184, 186, 187

[56] References Cited

U.S. PATENT DOCUMENTS 3,721,111 3/1973 Billi ..... 66/21
3,800,563 4/1974 Billi ..... 66/21
4,014,186 3/1977 Ferraguti ..... 66/25
4,047,401 9/1977 Nurk ..... 66/25

*Primary Examiner*—C. D. Crowder
*Assistant Examiner*—Larry D. Worrell, Jr.
*Attorney, Agent, or Firm*—Dykema Gossett PLLC

[57] ABSTRACT

A method of manipulating a garment on a knitting machine includes the steps of orienting the garment with an opening disposed relative to one end on the knitting machine; and knitting a bridge across the opening of the garment. The bridge is affixed to the garment at a first and second site. The first and second sites are disposed near the opening. The exact positioning of the first and second sites relative to the opening are predetermined in accordance with the orientation of the garment on the knitting machine. The first site opposes the second site. The method of manipulating the garment further includes the step of dividing the bridge forming a first and a second handle. The first and second handle are fixed at the first site and the second handle is affixed at the second site. The first and second handles are useful for further processing the garment.

15 Claims, 3 Drawing Sheets

KNIT GARMENT AND ORIENTATION METHOD

This application claims the benefit of U.S. Provisional Application Ser. No. 60/034,705 filed on Jan. 3, 1997.

FIELD OF USE

A method of orienting and manipulating knit garments that is readily adaptable for either manual or automatic operation, and more particularly, a method for closing the toe of knit stockings or for inverting the garment, or similar type operations.

BACKGROUND OF THE INVENTION

Manufacturers have sought a method to orientate and manipulate stockings on knitting machines without operator intervention as they automate their operations. The following patents illustrate several approaches:

U.S. Pat. No. 2,926,513 (Tew) discloses a method of closing a toe in a stocking, wherein the machine engaged in continuous circular knitting is converted to reciprocating knitting. It is during the reciprocating knitting that certain of the needles are disengaged while the remaining needles continue the knitting operation. Continuous circular knitting is thereafter resumed as all needles are engaged for the knitting operation and the toe portion is completed.

U.S. Pat. No. 3,800,559 (Fecker) discloses a method for closing the toe of stockings on known circular knitting machines. A toe-closing thread is knit into the toe end of a tubular mesh. The closing thread passes at least once around the entire periphery of the mesh. The mesh is then cast off the needles of a circular knitting machine and the closing thread is pulled or partially drawn out of the mesh, causing the mesh to be constricted thereby closing the toe. The closing thread is then knotted to prevent withdrawal of the thread.

U.S. Pat. No. 4,014,186 (Ferraguti) discloses a method for forming a closed end of a tubular knit sock on a circular knitting machine. After the last row of the tubular fabric is formed by needles slidably assembled in the grooves of the machine cylinder, two annular tubular layers are formed as continuations of the tubular knit fabric at separate stages by needles operating in the same cylinder of the machine. The loops at the free edge of the inner layer are then held on support arranged in a circle and the free edge of the inner layer is then held on support members arranged in a circle. The free edge of the outer layer is held by the needles until a relative rotation of at least 180 degrees between the circle of support members and the cylinder has been effected. The loops held onto the support members are transferred to the needles of the cylinder, and a final few rows are knit before the fabric is removed from the needles.

U.S. Pat. No. 4,958,507 (Allaire et al.) discloses a method for closing the toe of a double-layered sock. A first course knit by needles corresponding to the end of the tip of a first layer is transferred onto a central transfer plate of a machine where the sock is held. Knitting of the first layer continues from the tip to the mock-up edges. Then knitting is continued on the mock-up edges of the second layer to the tip, the knit tubular structure being suspended by one circular end, from the central transfer plate and, by the other circular end from the needle cylinder in the course of work, shaping the two concentric layers within each other. The initial course in standby on the plate is transferred to the needles of the cylinder to join the two layers together, and the toe is joined together by knitting.

While these methods have met with only limited success, none the opening as well as do linking machines.

One reason for this lack of success is the nature of a cylindrical knit garment. Each knit stitch depends upon the previous stitch knit on the same needle for stability and to prevent unraveling.

One proposed solution is to knit the opening of the stocking first. The last stitches at the top of the stocking unravel, even though attempts have been made to prevent this unraveling.

Another proposed solution is to include drawstrings into the stocking to close the opening end. This method works fairly well on ladies hosiery, but is too bulky for applications involving coarser knit fabrics.

Yet another proposed solution involves adapting small linking machines to become knitting machines. The stocking is removed from the needles by a split dial and linked onto the knitting machine. While this provides a satisfactory opening closure without operator intervention, many types of existing equipment are not readily adaptable to this conversion. Also, substantial costs are involved in converting the equipment resulting in additional maintenance. Accordingly, what is needed is a method that will manipulate and orient the stocking, turning and feeding existing opening closing equipment without operator assistance, rather than closing the opening of the stocking on the existing knitting machines.

A device and a method are needed that will enable precision orientation of a knit garment which is useful for either manual or automatic operation for further processing and completion of the garment.

SUMMARY OF THE INVENTION

If the corner locations of the garment are known, the garment can be mechanically fed into a sewing or linking machine for closing the opening. Also, the method of the present invention may be used to invert the garment in preparation for sewing or linking either on or off the knitting machine, as well as other similar type operations.

The method of the present invention is useful in manipulating a garment on a knitting machine. Initially, the garment is orientated with an opening disposed relative to one end on the knitting machine.

A bridge is then inserted across the opening of the garment, being affixed to the garment at a first and a second site, the two sites opposing each other relative to the opening. The bridge may be a plastic insert disposed across the opening, or may be knit into the garment across the opening. The two sites are disposed near the opening, the exact positioning of the sites relative to the opening being predetermined in accordance with the orientation of the garment on the knitting machine.

The bridge is then split or divided forming two handles. The first handle is affixed at the first site and the second handle is affixed at the second site. The first and second handles are useful for further processing of the knit garment.

Preferably, the garment is a stocking and the handles are used to orientate the stocking for closing the toe thereof. The two handles are pulled away from each other thereby drawing together the two end portions of the garment, enabling the two end portions to be attached together. The two handles may also be used for inverting and/or reinverting the garment for subsequent processing.

Preferably, the garment has a hollow and generally cylindrical shape, the general shape of the garment is asymmetrical, and the garment is right-side-out during processing.

For a more complete understanding of the garment and orientation method of the present invention, reference is made to the following detailed description and accompanying drawings in which the presently preferred embodiments of the invention are shown by way of example. As the invention may be embodied in many forms without departing from spirit of essential characteristics thereof, it is expressly understood that the drawings are for purposes of illustration and description only, and are not intended as a definition of the limits of the invention. Throughout the description, like reference numbers refer to the same component throughout the several views.

DETAILED DESCRIPTION OF THE PREFERRED EMBODIMENTS

The garment [10] of the present invention has a hollow, and generally cylindrical shape for closure at one end thereof. The garment [10] may be a child's pajama leg, the leg of a leggings, or even a knit cap. However, for purposes of discussion and illustration hereinafter, the garment [10] will be a stocking. Also, the manipulation and orientation of the stocking [10] will generally be for purposes of closing the toe of the stocking. It is also to be understood that "stocking" is applicable to all foot coverings, including men's socks, women's hosiery, and children's anklets.

Figure 1:
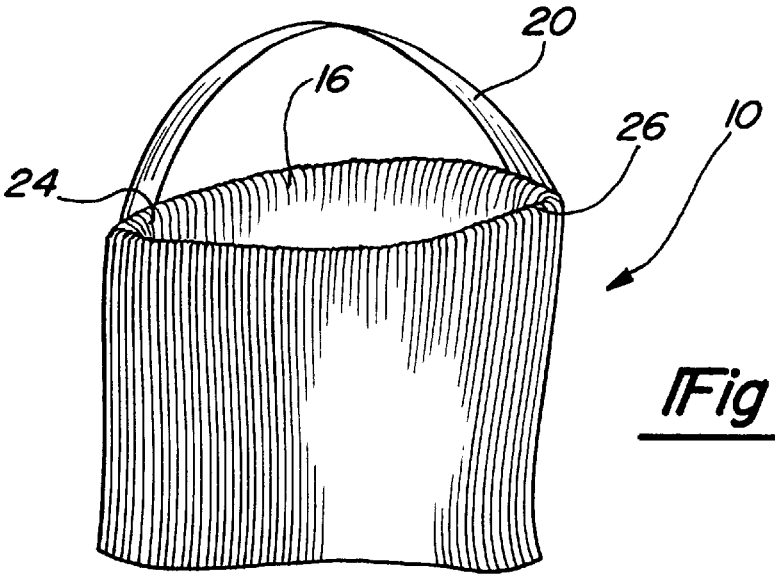
FIG. 1 discloses a first embodiment of the knit garment of the present invention as a plastic bridge has been attached to the garment at two sites near the opening.
Figure 2:
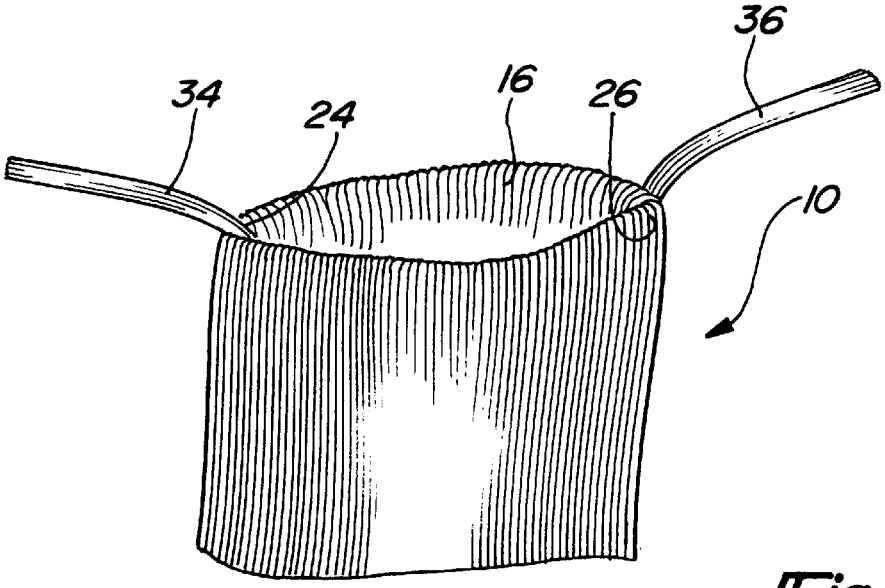
FIG. 2 discloses the first embodiment of the knit garment of FIG. 1, as the plastic bridge has been severed forming two opposed handles across the garment opening.

Referring now to the drawings, FIGS. 1 and 2 disclose the knit stocking [10] of the first preferred embodiment of the present invention and the method of assembly thereof. While the principles of the present invention are applicable to generally symmetrical stockings such as tube socks, the general shape of the stocking [10] is preferably asymmetrical, since orientation asymmetrical shapes require the most precision.

A bridge [20] is secured into the end portions [16] of the stocking [10]. If there has been reciprocating knitting, the cord is inserted one or more courses after the last course at the corners of the opening [16]. If there has been no reciprocating knitting, the bridge is inserted within the last few courses of the stocking.

FIG. 1 discloses a semi-rigid bridge [20] attached to the stocking [10] at two sites [24 and 26] near the opening [16] of the stocking [10]. FIG. 2 discloses the same semi-rigid bridge [20] having been severed, forming two opposed handles [34 and 36] across the opening [16]. While the bridge [20] may be made of any semi-rigid material, plastic cord or wire is preferred.

The exact location of the two sites [24 and 26] about the opening [16] is determined in accordance with the orientation of the stocking [10] on the knitting machine as part of the knitting process. The stocking [10] may also be orientated by the use of special fibers with optical or receptive properties. The fibers are sensed by an optical sensor or electronic sensor at the corners of the opening [16]. Once these fibers are located, the orientation of the stocking is determined.

The bridge [20] is either manually or by automatically inserted into opposing ends near the opening [16]. Once the bridge [20] has been secured to the stocking [10], the orientation of the stocking [10] is implanted into the stocking and may thereafter be determined by the location of the sites [24 and 26].

Once the bridge [20] has been severed, the toe closure may proceed simply by applying tension across the two handles [34 and 36] and through the stocking [10] drawing the two opposing lips [44 and 46] of the toe pocket [49] together for attachment by conventional methods.

The handles [34 and 36] are useful whenever further processing of the stocking [10] is needed, such as toe closure, stocking inversion, stocking reinversion, the transfer of the stocking from the knitting machine to another machine, or the like. The stocking [10] is knit in right-side-out and is inverted to close the toe, and then reinverted. Since the handles [34 and 36] are disposed near the opening [16], the handles [34 and 36] are useful while inverting, and reinverting.

Figure 3:
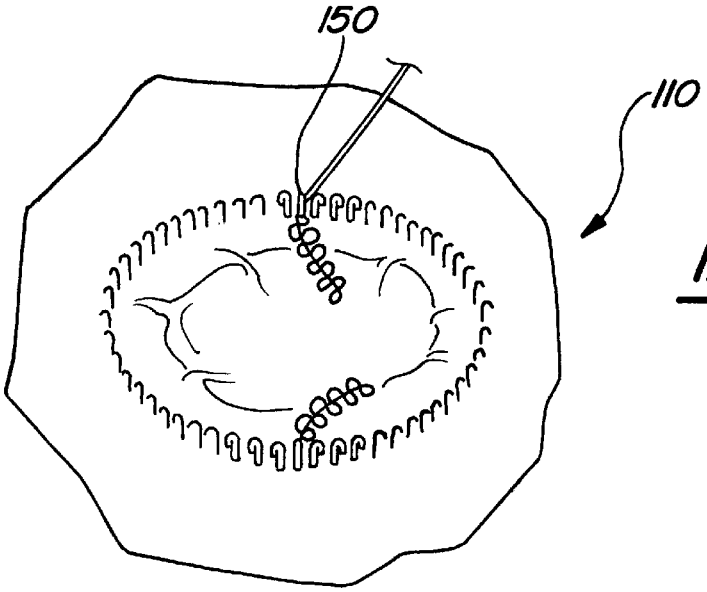
FIG. 3 discloses a second embodiment of the garment of the present invention after knitting of the opening has been completed and just prior to the bridge being knit into the garment, as all needles are knitting.
Figure 4:
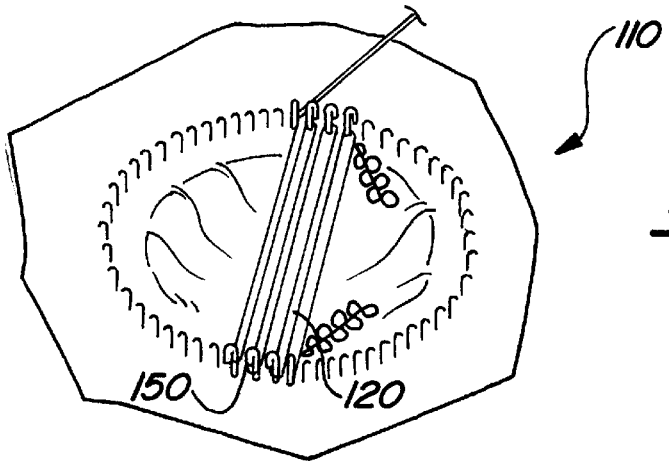
FIG. 4 discloses the garment of FIG. 3 after the knitting of the bridge has begun, and less than all of the needles are knitting.
Figure 5:
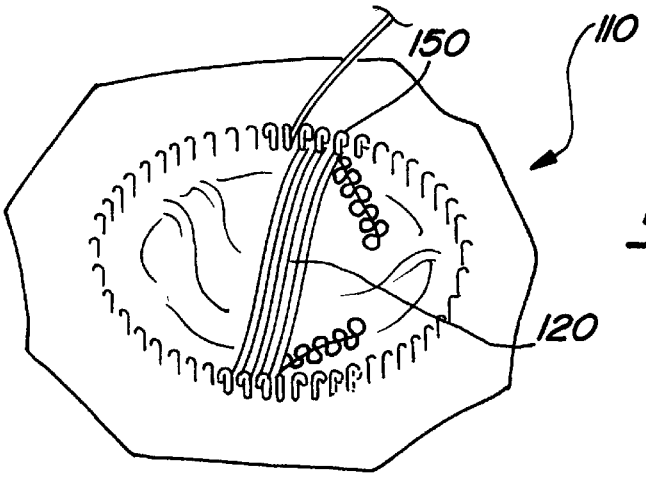
FIG. 5 discloses the knit garment of FIG. 4 after the bridge has been knit, as all needles are knitting.

FIGS. 3, 4, and 5 depict an orientation method and knit stocking [110] of the second preferred embodiment of the invention. In this embodiment, the bridge [120] is knit into the stocking [110], and the knit material is the same material as the stocking material. In FIG. 3, all needles [150] are knitting after the reciprocated toe [152] has been knit and just prior to the bridge [120] being knit into the stocking. The bridge [120] is knit into the stocking [110] starting one or more courses after a last course at the corners of the end of the stocking [110] or, starting within the last few courses of the stocking [110]. Courses are not being added while the bridge [120] is inserted. The yarn feed while the bridge [120] is being added is essentially the same as the yarn feed while the courses are added.

On a circular knitting machine, one or more needles [150] are selected on each side of the stocking [110] to mark exact locations of the specific sites [124 and 126] on the stocking [110]. A bridge [120] comprising one or more yarns is thereafter formed across the opening between these selected needles [150] providing a "handle" for manipulation. With reciprocating knitting, the bridge [120] is knit starting one or more courses after the last course [140] of the opening end. With circular knitting, the placement of the bridge [120] is not so critical, and need only be within the last few courses [140] of the stocking end.

FIG. 4 discloses the stocking [110] after the reciprocated opening [116] has been knit and the knitting of the bridge

[120] has begun. Preferably, the bridge [120] comprises three strands of yarn, and are aligned with the corners of the gores which have been knit into the toe pocket. It is recommended that the needles used in the process may be alternating needles on each side of the stocking [10], with an idle needle between each one.

FIG. 5 shows the knit stocking [110] after the reciprocated opening has been completed, and the bridge [120] has been completed. All needles are now taking on yarn and have resumed knitting.

Figure 6:
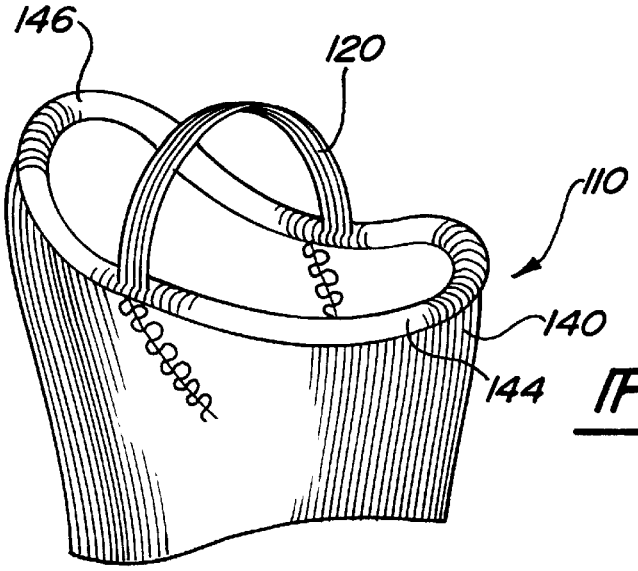
FIG. 6 discloses a knit garment having the bridge across the open end of the garment.
Figure 7:
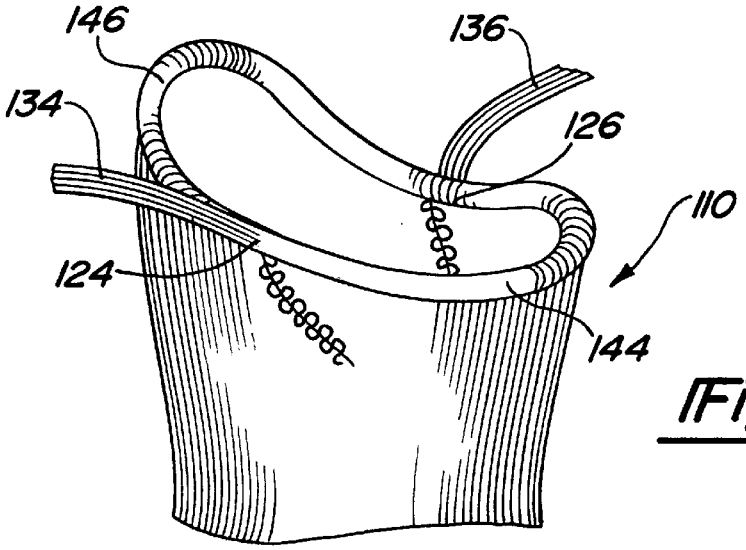
FIG. 7 discloses the knit garment of the present invention of FIG. 6 after the bridge has been severed and the two handles are pulled taut.
Figure 8:
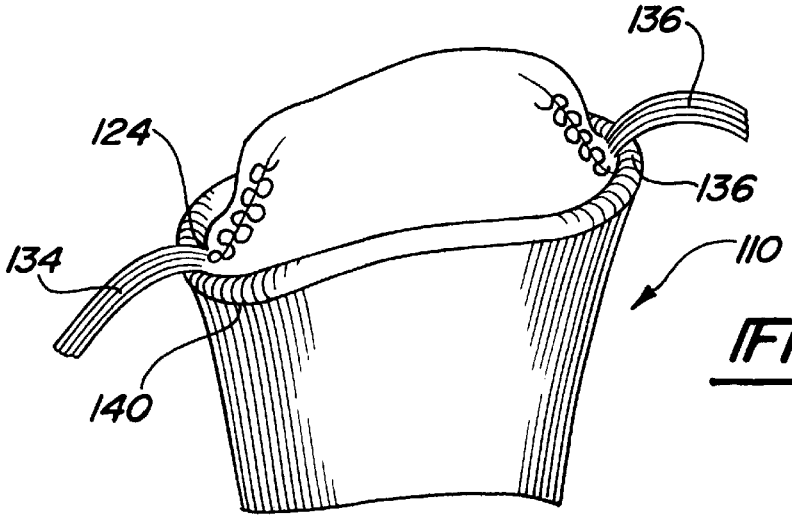
FIG. 8 discloses the knit garment with the handles pulled taut and the opposing portions manipulated as the garment is now ready to be closed.

FIG. 6 shows the knit stocking [110] with the bridge [120] of knit material across the opening [116] of the stocking [110]. FIG. 7 shows the knit stocking [110] after the bridge [120] of knit material has been severed forming the two handles [124 and 126] of knit material which are being pulled taut. FIG. 8 shows the handles [124 and 126] pulled taut and the opposing lip portions [144 and 146] of the stocking [110] being manipulated as the stocking [110] is prepared for toe closure.

It is evident that many alternatives, modifications, and variations of the garments and orientation methods of the present invention will be apparent to those skilled in the art in light of the disclosure herein. It is intended that the metes and bounds of the present invention be determined by the appended claims rather than by the language of the above specification, and that all such alternatives, modifications, and variations which form a conjointly cooperative equivalent are intended to be included within the spirit and scope of these claims.

I claim:

1. A method of manipulating a garment having an opening with a first lip portion and a second lip portion on a knitting machine, the method comprising:

(a) orientating the garment with an opening disposed relative to one end on the knitting machine;

(b) knitting a bridge across the opening of the garment, the bridge being affixed to the garment at a first and a second site, the first and second sites being disposed near the opening, exact positioning of the first and second sites relative to the opening being predetermined in accordance with the orientation of the garment on the knitting machine, the first site opposing the second site; and (c) dividing the bridge forming a first and second handle, the first handle being affixed at the first site and the second handle being affixed at the second site, the first and second handles being useful for further processing of the garment.

2. The garment manipulation method of claim 1, further comprising grasping the first and second handle, pulling the first handle away from the second handle thereby drawing together a first lip portion to a second lip portion of the garment enabling the first lip portion to be attached to the second lip portion, the first lip portion opposing the second lip portion, the first lip portion being disposed between the first and second handles, the second lip portion being disposed between the second and first handles.

3. The garment manipulation method of claim 2, further comprising grasping the first and second handle and inverting the garment.

4. The garment manipulation method of claim 1, further comprising grasping the first and second handle and inverting the garment.

5. The garment manipulation method of claim 1, wherein the bridge is inserted by selecting at least one needle on each side of the garment, and marking specific sites of the garment on a circular knitting machine.

6. The garment manipulation method of claim 1, wherein the garment has a hollow and generally cylindrical shape.

7. The garment manipulation method of claim 1, wherein the general shape of the garment is asymmetrical.

8. The garment manipulation method of claim 1, wherein the garment is inverted during the orientation.

9. A method of manipulating a garment having an opening with a first lip portion and a second lip portion on a knitting machine, the method comprising:

(a) orientating the garment on the knitting machine with an opening disposed therein;

(b) attaching a bridge near an open end of the garment, the bridge being made of a material different than the garment material, the bridge being secured to a first site and a second site, the first and second sites being disposed near the open end of the garment, exact positioning of the first and second sites relative to the opening being predetermined in accordance with the orientation of the garment on the knitting machine, the first site opposing the second site; and (c) dividing the bridge forming a first and second handle, the first handle being affixed at the first site and the second handle being affixed at the second site, the first and second handles being useful for further processing of the garment.

10. The garment manipulation method of claim 9, further comprising grasping the first and second handle, pulling the first handle away from the second handle thereby drawing together a first lip portion to a second lip portion of the garment enabling the first lip portion to be attached to the second lip portion, the first lip portion opposing the second lip portion, the first lip portion being disposed between the first and second handles, the second lip portion being disposed between the second and first handles.

11. The garment manipulation method of claim 9, further comprising grasping the first and second handle and inverting the garment.

12. The garment manipulation method of claim 9, further comprising grasping the first and second handle and inverting the garment.

13. The garment manipulation method of claim 9, wherein the bridge of material comprises a wire or plastic cord.

14. The garment manipulation method of claim 9, wherein the general shape of the garment is asymmetrical.

15. The garment manipulation method of claim 9, wherein special fibers with receptive properties and optical sensors disposed at the corners of the opening are used to determine the location of the sites.

* * * * *